US012251021B2

(12) United States Patent
Baoping

(10) Patent No.: US 12,251,021 B2
(45) Date of Patent: Mar. 18, 2025

(54) THEATER CHAIR

(71) Applicant: ENPAR SEATING, LLC, Clovis, NM (US)

(72) Inventor: Yang Baoping, Nanjing (CN)

(73) Assignee: ENPAR SEATING, LLC, Clovis, NM (US)

( * ) Notice: Subject to any disclaimer, the term of this patent is extended or adjusted under 35 U.S.C. 154(b) by 13 days.

(21) Appl. No.: 18/104,598

(22) Filed: Feb. 1, 2023

(65) Prior Publication Data

US 2024/0251949 A1 Aug. 1, 2024

(51) Int. Cl.
*A47C 1/12* (2006.01)
*A47C 1/024* (2006.01)

(52) U.S. Cl.
CPC ..... *A47C 1/12* (2013.01); *A47C 1/0242* (2013.01)

(58) Field of Classification Search
CPC ..... A47C 1/12; A47C 1/0242; A47C 1/03211
USPC ..... 297/330, 317
See application file for complete search history.

(56) References Cited

U.S. PATENT DOCUMENTS 4,386,803 A * 6/1983 Gilderbloom ..... A47C 1/036 297/83
4,966,413 A * 10/1990 Palarski ..... A47C 7/38 297/284.6
5,062,676 A * 11/1991 Mars ..... A47C 1/024 297/284.3
5,076,644 A * 12/1991 Northcutt ..... A47C 1/0345 297/DIG. 10
5,098,158 A 3/1992 Palarski
6,752,463 B2 * 6/2004 Nivet ..... B60N 2/16 297/423.36
9,326,608 B1 5/2016 Hoy et al.
9,730,518 B1 * 8/2017 Jacobs ..... A47C 7/70
10,888,162 B1 1/2021 McLennan
2002/0149248 A1 * 10/2002 Jackson ..... F15B 7/02 297/330
2005/0052067 A1 * 3/2005 Grimm ..... A47C 17/134 297/423.2
2008/0018157 A1 * 1/2008 Dewert ..... A47C 1/0242 297/354.12
2011/0062755 A1 * 3/2011 Gil ..... A47C 1/12 297/232
2011/0198894 A1 * 8/2011 Hsieh ..... A47C 1/0242 297/68

(Continued)

FOREIGN PATENT DOCUMENTS

CN 307686343 S 11/2022

OTHER PUBLICATIONS

PCT, Written Opinion of the International Searching Authority, May 8, 2024.
PCT, International Search Report, May 8, 2024.

*Primary Examiner* — Jose V Chen
(74) *Attorney, Agent, or Firm* — Kameron W. Kramer

(57) ABSTRACT

A theater chair that is mountable on existing theater platforms that provides a tilting backrest, an extendable footrest, and an extendable headrest, each independently operated by a separate motor. The theater chair comprises a mountable base, a backrest, a headrest, a footrest, a seat cushion, and three motors. The three motors are controlled by a controller operated by the user to facilitate the tilting of the backrest, the extending of the footrest, and the extending of the headrest, as desired.

7 Claims, 14 Drawing Sheets

(56) References Cited

U.S. PATENT DOCUMENTS

| | | | | |
|---|---|---|---|---|
| 2016/0374469 | A1* | 12/2016 | Ham | A47C 7/407<br>297/248 |
| 2017/0293281 | A1* | 10/2017 | Li | A47C 1/0242 |
| 2017/0347797 | A1* | 12/2017 | Robertson | A47C 1/0242 |
| 2020/0069490 | A1* | 3/2020 | Gassner | A47C 31/00 |
| 2020/0154893 | A1* | 5/2020 | Olarte | A47C 7/50 |
| 2020/0214448 | A1* | 7/2020 | Jacobs | A47C 7/723 |
| 2020/0253379 | A1* | 8/2020 | Song | A47C 1/03211 |

* cited by examiner

THEATER CHAIR

TECHNICAL FIELD

The present disclosure relates to chairs, and more specifically, to chairs designed to be installed in theaters.

PRIOR ART

Reclining chairs, including motorized reclining chairs, are abundant in the prior art. U.S. Pat. No. 4,386,803 titled "Motorized Reclining Chair" with Gilderbloom as the inventor is such a motorized reclining char. There are typically various parts of reclining chairs that can be motorized, including footrest, headrest, backrest, seat cushion, etc.

Movie theaters began retrofitting their theaters to offer such motorized reclining chairs in the past few decades. This is in contrast to the traditional theater chairs that are close together and offer only a slight lean backward.

Existing theaters retrofit their theaters to include new motorized, reclining seating, while new theaters are being built with this new motorized, reclining seating. For existing theaters, typically every other row is taken out and an L-shaped platform remains (or an L-shaped platform is installed). New reclining chairs are then placed on these L-shaped platforms and mounted. This permanent mounting allows the chairs to be motorized and offer a variety of reclining and other options.

There exists a need for chairs that can be easily retrofitted to existing theater, and installed in new theaters, that allow for a variety of options in addition to simply reclining.

SUMMARY OF THE INVENTION

The present disclosure provides a theater chair, comprising a mountable base, wherein the mountable base consists of a pair of L-shaped bases formed by a pair of vertical members and a pair of horizontal members, wherein the of L-shaped bases are connected by one or more L-base support bars; a seat cushion, wherein the seat cushion is disposed parallel to the horizontal member; a backrest, wherein the backrest is disposed adjacent to the seat cushion and tilts rearward and forward in relation to the seat cushion; a footrest, wherein the footrest is disposed adjacent to the seat cushion and extends to the open position and retracts to the closed position in relation to the vertical member; a headrest, wherein the headrest is disposed adjacent to the backrest and extends outwardly and inwardly in relation to the backrest; a first motor, wherein the first motor is connected to the backrest and facilitates the rearward and forward tilting of the backrest; a second motor, wherein the second motor is connected to the extendable footrest and facilitates the extension and retraction of the extendable footrest; and a third motor, wherein the third motor is connected to the headrest and facilitates the outward and inward extension of the headrest in relation to the backrest. The mountable base of the theater chair of the present invention is mountable on a seating platform comprising a vertical wall and a horizontal wall.

None of the prior art fully addresses the problems resolved by the present invention. The present invention overcomes these limitations contained in the prior art.

Certain embodiments of the invention have other steps or elements in addition to or in place of those mentioned above. The steps or element will become apparent to those skilled in the art from a reading of the following detailed description when taken with reference to the accompanying figures, if any.

DETAILED DESCRIPTION OF THE INVENTION

Figure 1:
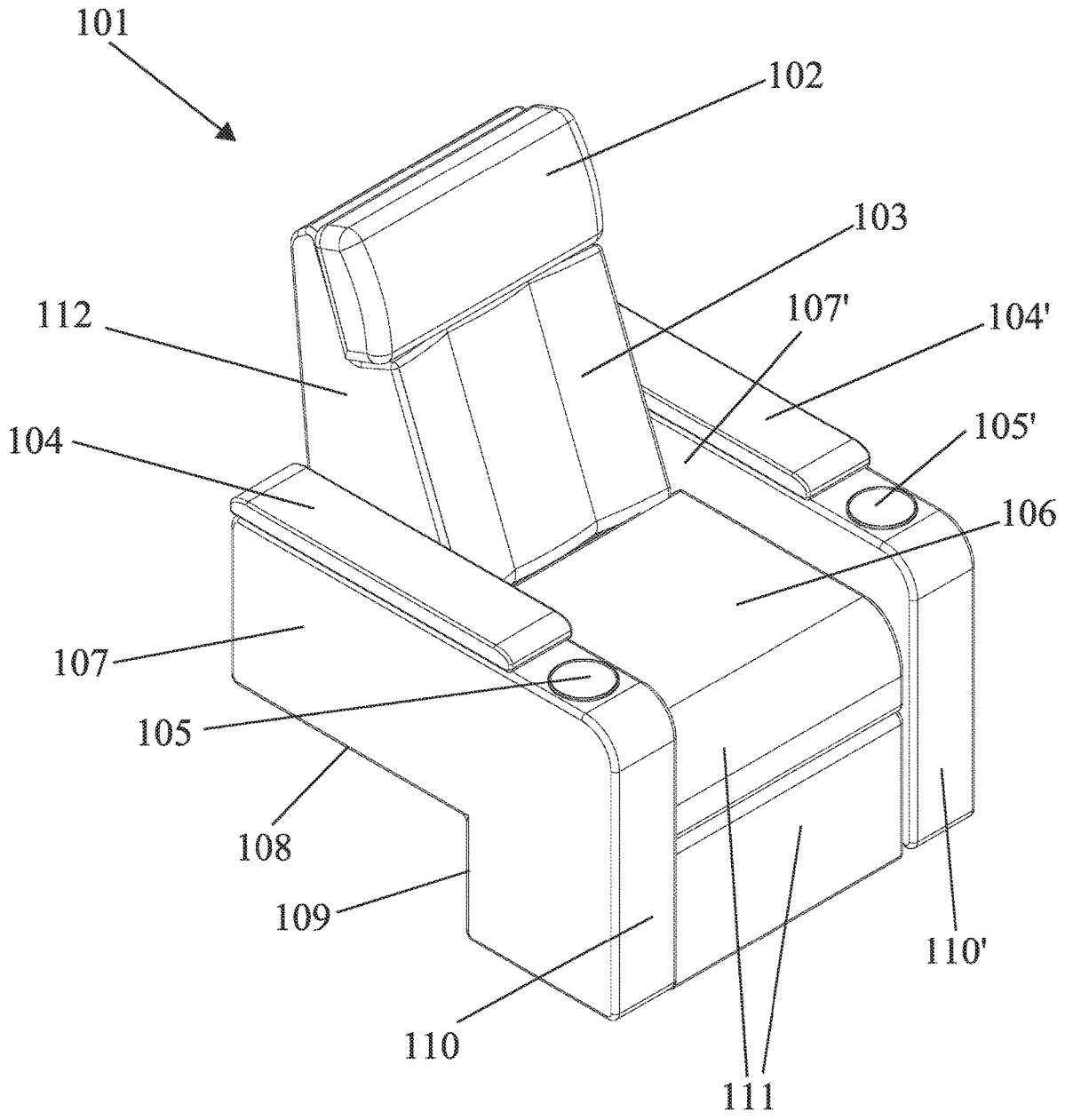
FIG. 1 illustrates a perspective view of the theater chair of the present invention.

The best mode for carrying out the invention will be described herein. The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. To avoid obscuring the present invention, some well-known system configurations, and process steps are not disclosed in detail. The figures illustrating embodiments of the system, if any, are semi-diagrammatic and not to scale and, particularly, some of the dimensions are for the clarity of presentation and are shown exaggerated in the drawing figures.

Alternate embodiments have been included throughout, and the order of such are not intended to have any other significance or provide limitations for the present invention.

For expository purposes, the term "horizontal" as used herein is defined as a plane parallel to the plane or surface of the present apparatus, regardless of its orientation. The term "vertical" refers to a direction perpendicular to the horizontal as just defined. Terms, such as "above", "below", "bottom", "top", "side", "higher", "lower", "upper", "over", and "under", are defined with respect to the horizontal plane, as shown in the figures, if any. The term "on" means that there is direct contact among elements.

Elements in the figures that are numbered with an apostrophe (') mean they are corresponding pieces to their counterparts that do not have the apostrophe (), such as 105 and 105'. The right side pieces, if any, are denoted with the apostrophe (). A set of two corresponding pieces, such as 105 and 105', may be referred to as a "pair" when referring to both pieces.

Dotted lines in the figures denote parts of the apparatus that are not visible from the current view.

The present disclosure provides a theater chair, comprising a mountable base, wherein the mountable base consists of a pair of L-shaped bases formed by a pair of vertical members and a pair of horizontal members, wherein the of L-shaped bases are connected by one or more L-base support bars; a seat cushion, wherein the seat cushion is disposed parallel to the horizontal member; a backrest, wherein the backrest is disposed adjacent to the seat cushion and tilts rearward and forward in relation to the seat cushion; a footrest, wherein the footrest is disposed adjacent to the seat cushion and extends to the open position and retracts to the closed position in relation to the vertical member; a headrest, wherein the headrest is disposed adjacent to the backrest and extends outwardly and inwardly in relation to the backrest; a first motor, wherein the first motor is connected to the backrest and facilitates the rearward and forward tilting of the backrest; a second motor, wherein the second motor is connected to the extendable footrest and facilitates the extension and retraction of the extendable footrest; and a third motor, wherein the third motor is connected to the headrest and facilitates the outward and inward extension of the headrest in relation to the backrest.

The mountable base of the theater chair of the present invention is mountable on a seating platform comprising a vertical wall and a horizontal wall.

The theater chair of the present invention further comprises a mountable base, wherein the mountable base consists of a pair of L-shaped bases formed by a pair of vertical members and a pair of horizontal members, wherein the of L-shaped bases are connected by one or more L-base support bars; a seat cushion, wherein the seat cushion is disposed parallel to the horizontal member; a backrest; a backrest hinge, wherein the backrest hinge is hingeably attached to the backrest and the seat cushion, wherein the backrest is hingeably attached to the backrest hinge and is disposed adjacent to the seat cushion and tilts rearward and forward in relation to the seat cushion; a pair of side base walls, wherein the backrest is hingeably attached to the pair of side base walls; a pair of arm rests, wherein the pair of arm rests are disposed on the pair of side base walls; a pair of backrest side panels, wherein the pair of backrest side panels are disposed on the backrest; a seatback rear panel, wherein the seatback rear panel is securably attached to the seatback; a pair of side rear base walls, wherein pair of side rear base walls are attached to the pair of arm rests; a lower rear panel, wherein the lower rear panel is attached to the pair of side rear base walls; a footrest; a footrest hinge, wherein the footrest hinge is hingeably attached to the footrest and the seat cushion, wherein the footrest is hingeably attached to the footrest hinge and is disposed adjacent to the seat cushion and extends to the open position and retracts to the closed position in relation to the vertical member; a headrest; a headrest hinge, wherein the headrest hinge is hingeably attached to the backrest and the headrest, wherein the headrest is hingeably attached to the headrest hinge and is disposed adjacent to the backrest and extends outwardly and inwardly in relation to the backrest; wherein the headrest is disposed on the headrest hinge and adjacent to the backrest and extends outwardly and inwardly in relation to the backrest; a first motor, wherein the first motor is connected to the backrest hinge and facilitates the rearward and forward tilting of the backrest; a second motor, wherein the second motor is connected to the footrest hinge and facilitates the extension and retraction of the footrest; and a third motor, wherein the third motor is connected to the headrest hinge and facilitates the outward and inward extension of the headrest in relation to the backrest.

The pair of side base wall, the pair of backrest side panels, the seatback rear panel, the pair of side rear base walls, the lower rear panel, and the footrest when in the closed position generally conceal the backrest hinge, the footrest hinge, the headrest hinge, the first motor, the second motor, and the third motor when the theater chair is disposed on an L-shaped seating platform.

In an alternate embodiment of the present invent, the theater chair comprises an inner skeleton; a mountable base, wherein the mountable base consists of a pair of L-shaped bases formed by connecting to the inner skeleton; a seat cushion, wherein the seat cushion is disposed on the inner skeleton parallel to the horizontal member; a backrest; a backrest hinge, a pair of side base walls, wherein the backrest is hingeably attached to the inner skeleton; a pair of backrest side panels, wherein the pair of backrest side panels are disposed on the inner skeleton; a seatback rear panel, wherein the seatback rear panel is securably attached to the inner skeleton; a pair of side rear base walls, wherein pair of side rear base walls are attached to the inner skeleton; a lower rear panel, wherein the lower rear panel is attached to the inner skeleton; a footrest; a footrest hinge, wherein the footrest hinge is hingeably attached to the footrest and the inner skeleton, wherein the footrest is hingeably attached to the footrest hinge and is disposed adjacent to the seat cushion and extends to the open position and retracts to the closed position in relation to the vertical member; a headrest; a headrest hinge, wherein the headrest hinge is hingeably attached to the headrest and the inner skeleton, wherein the headrest is hingeably attached to the headrest hinge and is disposed adjacent to the backrest and extends outwardly and inwardly in relation to the backrest; wherein the headrest is disposed on the headrest hinge and adjacent to the backrest and extends outwardly and inwardly in relation to the backrest; a first motor, wherein the first motor is disposed on the inner skeleton and connected to the backrest hinge and facilitates the rearward and forward tilting of the backrest; a second motor, wherein the second motor is disposed on the inner skeleton and is connected to the footrest hinge and facilitates the extension and retraction of the footrest; and a third motor, wherein the backrest hinge is hingeably attached to the backrest and the inner skeleton, wherein the backrest is hingeably attached to the backrest hinge and is disposed adjacent to the seat cushion and tilts rearward and forward in relation to the seat cushion; a pair of arm rests, wherein the pair of arm rests are disposed on the inner skeleton; wherein the third motor is disposed on the inner skeleton and connected to the headrest hinge and facilitates the outward and inward extension of the headrest in relation to the backrest.

FIG. 1 illustrates a perspective view of theater chair 101 of the present invention. Left vertical member 109 and left horizontal member 108 are connected and comprise an L-shaped base. Right vertical member and right horizontal member, shown in FIG. 13, create a corresponding L-shaped base. The pair of L-shaped bases formed by left vertical member 109 and left horizontal member 108 and right vertical member 109' and right horizontal member 108' are connected by L-base support bars 1301 to form the mountable base of theater chair 101.

Seat cushion 106 is disposed substantially parallel to horizontal member 108. Backrest 103 is disposed adjacent to seat cushion 106. Headrest 102 is disposed adjacent to backrest 103. Footrest 111 is disposed adjacent to seat cushion 106. Backrest 103 is hingeably or rotatably attached to left side base wall 107 and right side base wall 107'. Backrest left side panel 112 is disposed on the left side of backrest 103. Backrest right side panel 112' is now shown in this figure but is disposed on the right side of backrest 103. Seat cushion 106 is securably attached to left side base wall 107 and right side base wall 107'. Left arm rest 104 and right arm rest 104' are disposed on left side base wall 107 and right side base wall 107', respectively. Left cupholder 105 and right cupholder 105' are disposed on left side base wall 107 and right side base wall 107', respectively. Either or both of left cupholder 105 and right cupholder 105' may be omitted from theater chair 101, or placed in any other suitable locations.

The mountable base created by the pair of L-shaped bases is mountable on a seating platform comprising a vertical wall and a horizontal wall, which is common in theaters, including theaters that are being retrofitted with new seating. Seating platforms of theaters are typically L-shaped, and the L-shaped base of the present invention fits snugly on the platform and can be secured in place.

Figure 2:
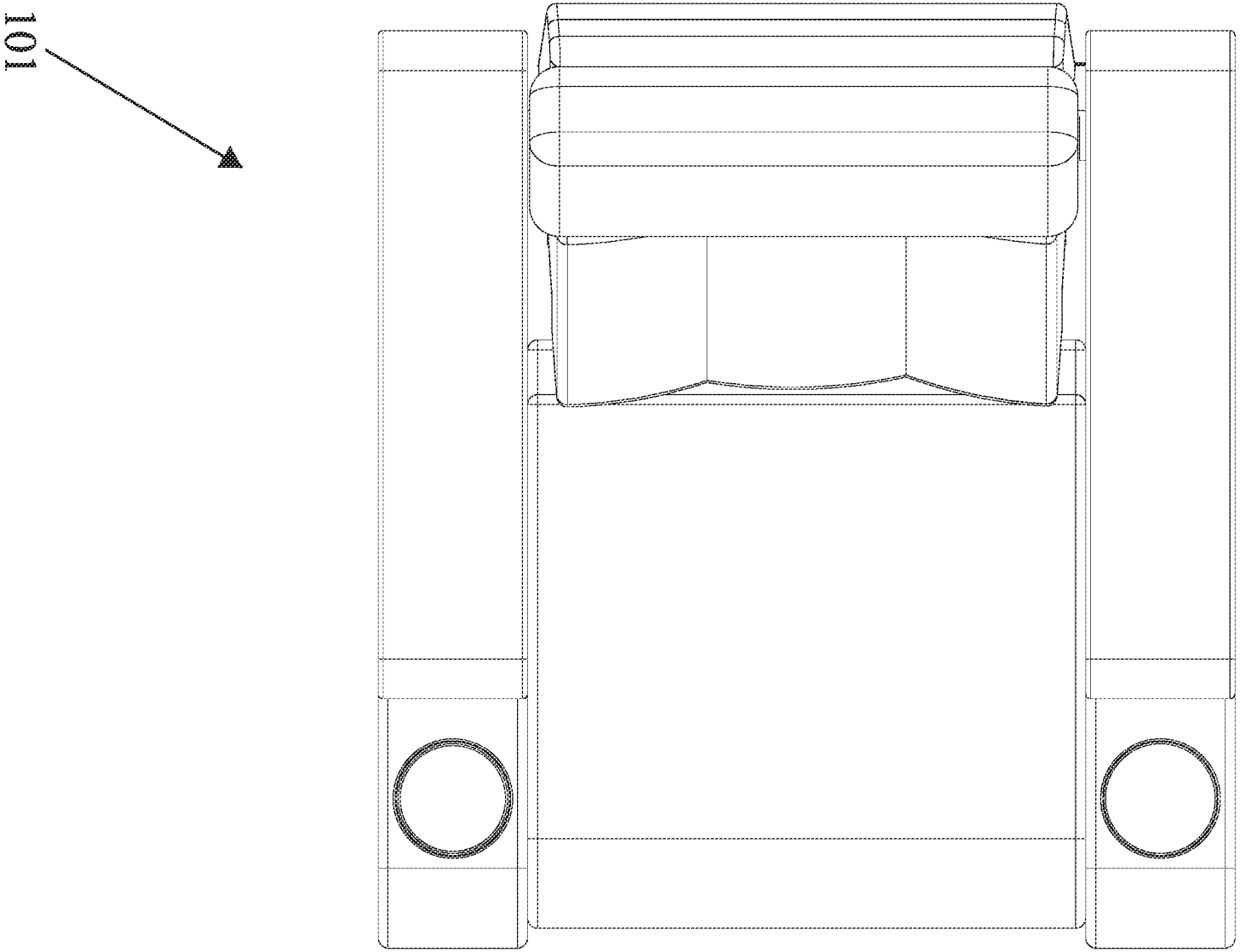
FIG. 2 illustrates a top down view of the theater chair of the present invention.

FIG. 2 illustrates a top down view of theater chair 101 of the present invention.

Figure 3:
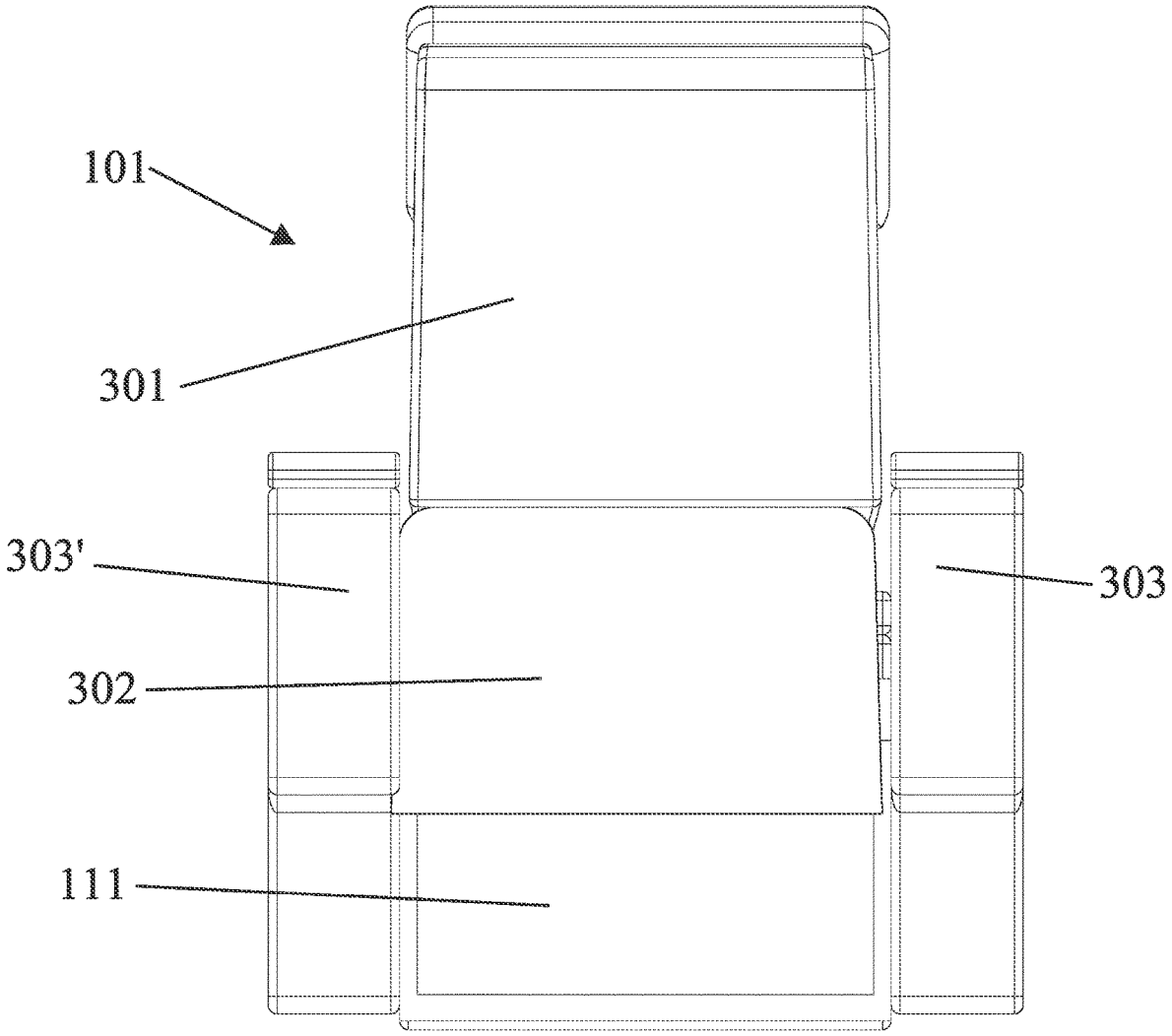
FIG. 3 illustrates a rear view of the theater chair of the present invention.

FIG. 3 illustrates a rear view of theater chair 101 of the present invention. Seatback rear panel 301 and lower rear panel 302 and left side rear base wall 303 and right side rear base wall 303' are shown. The backside of footrest 111 is shown in this figure. Left side rear base wall 303 and right side rear base wall 303' are attached to left arm rest 104 and right arm rest 104', respectively.

Figure 4:
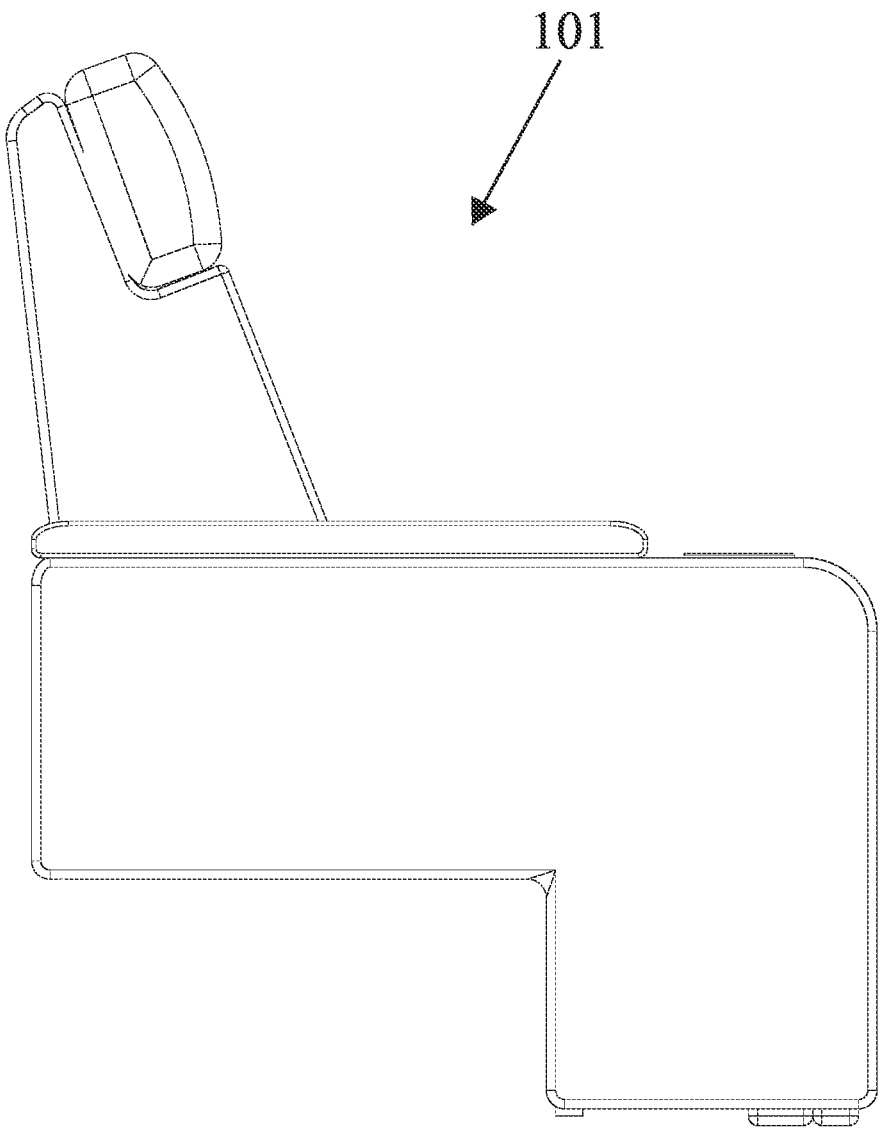
FIG. 4 illustrates a left side view of the theater chair of the present invention.

FIG. 4 illustrates a left side view of theater chair 101 of the present invention.

Figure 5:
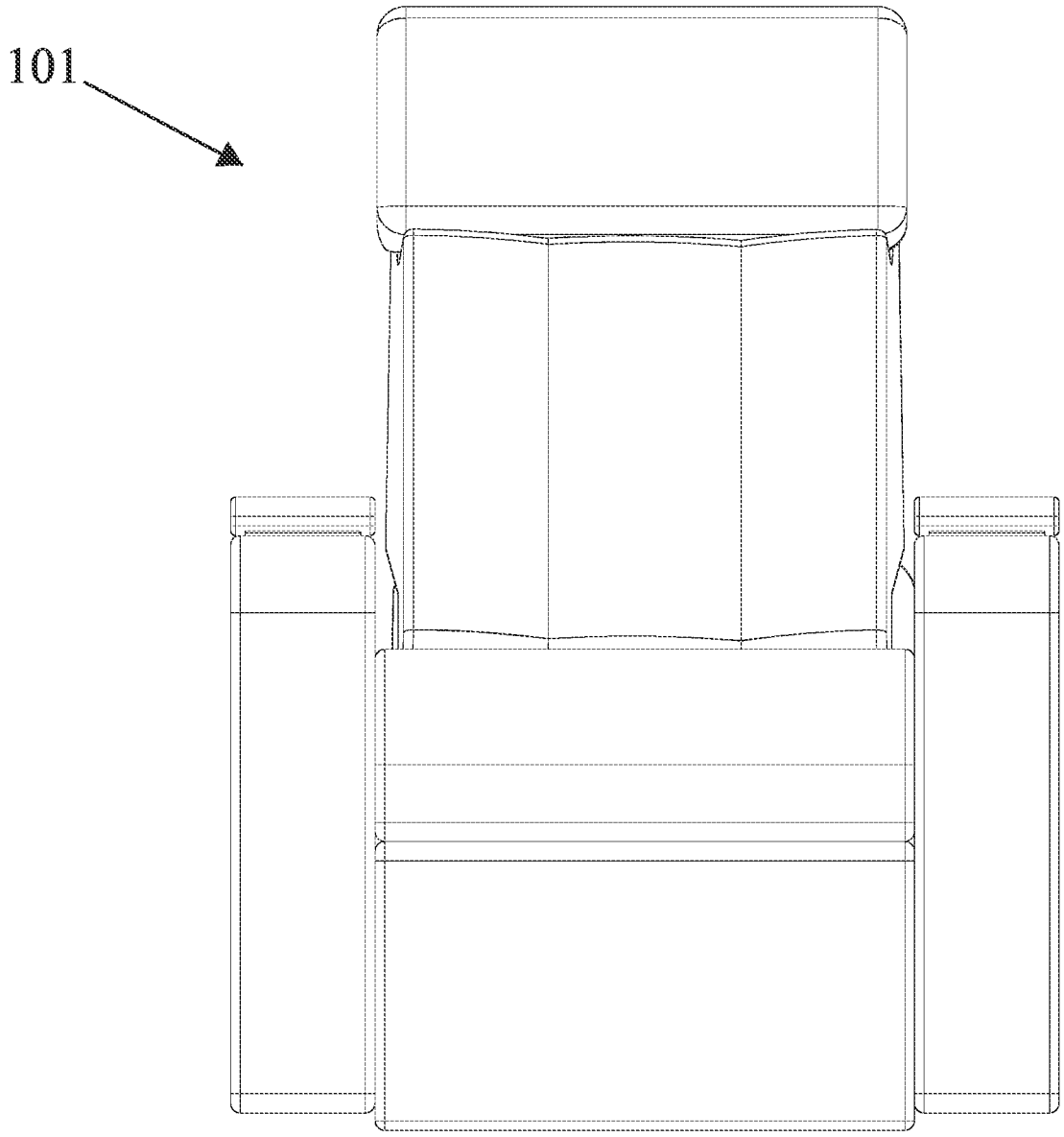
FIG. 5 illustrates a front view of the theater chair of the present invention.

FIG. 5 illustrates a front view of theater chair 101 of the present invention.

Figure 6:
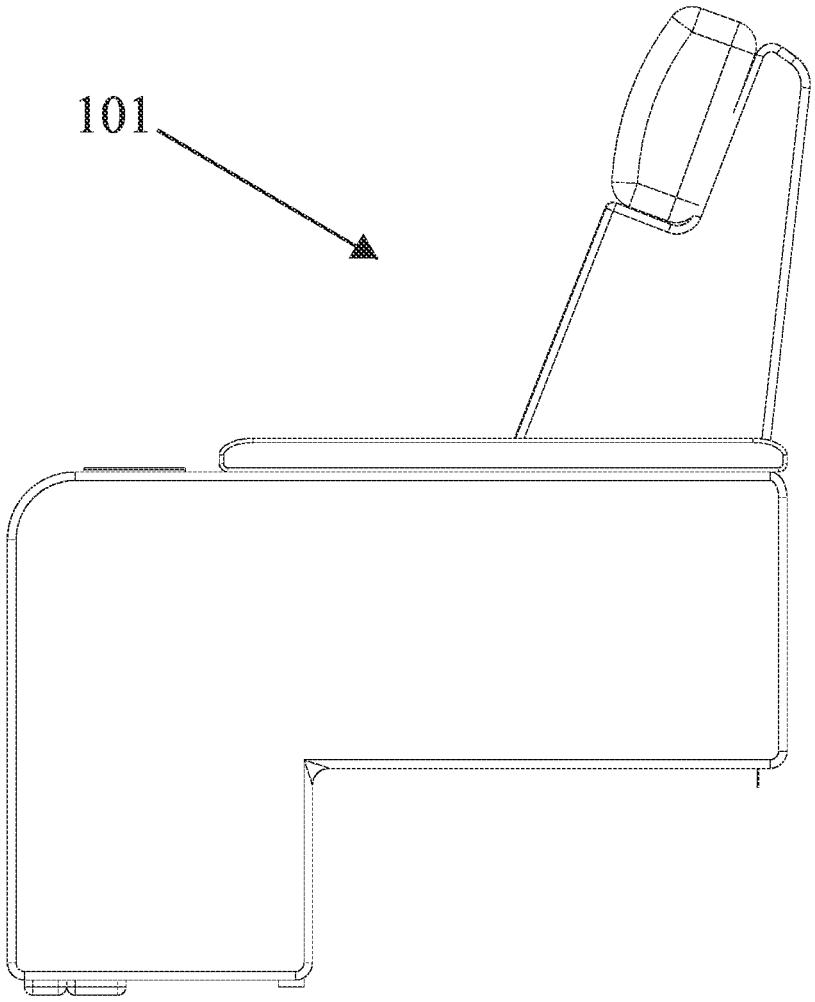
FIG. 6 illustrates a right side view of the theater chair of the present invention.

FIG. 6 illustrates a right side view of theater chair 101 of the present invention.

Figure 7:
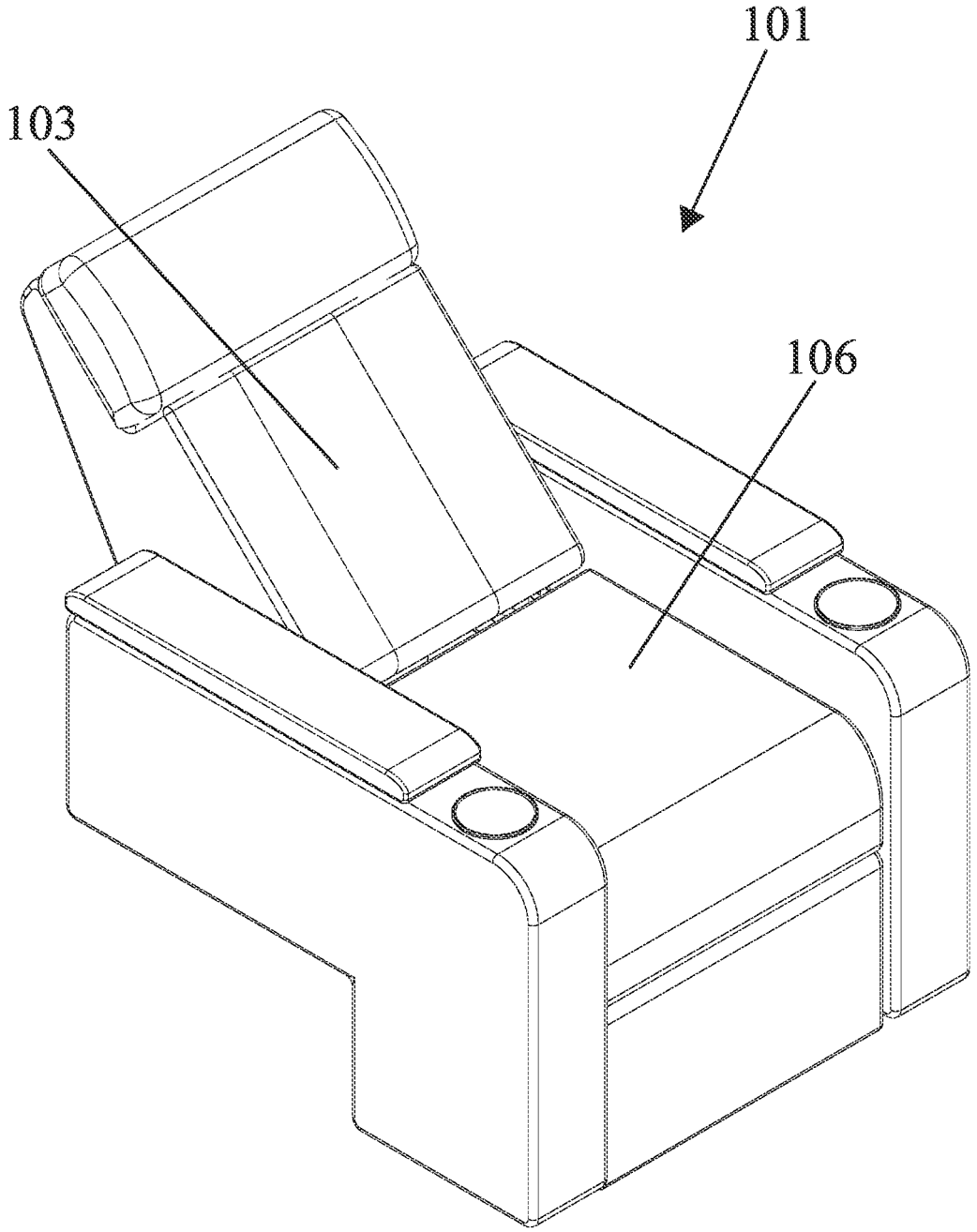
FIG. 7 illustrates a perspective view of the theater chair of the present invention with the backrest in the reclining position.

FIG. 7 illustrates a perspective view of theater chair 101 of the present invention with backrest 103 in the reclining position. Backrest 103 is disposed adjacent to seat cushion 106 and tilts rearward and forward in relation to seat cushion 106.

Figure 8:
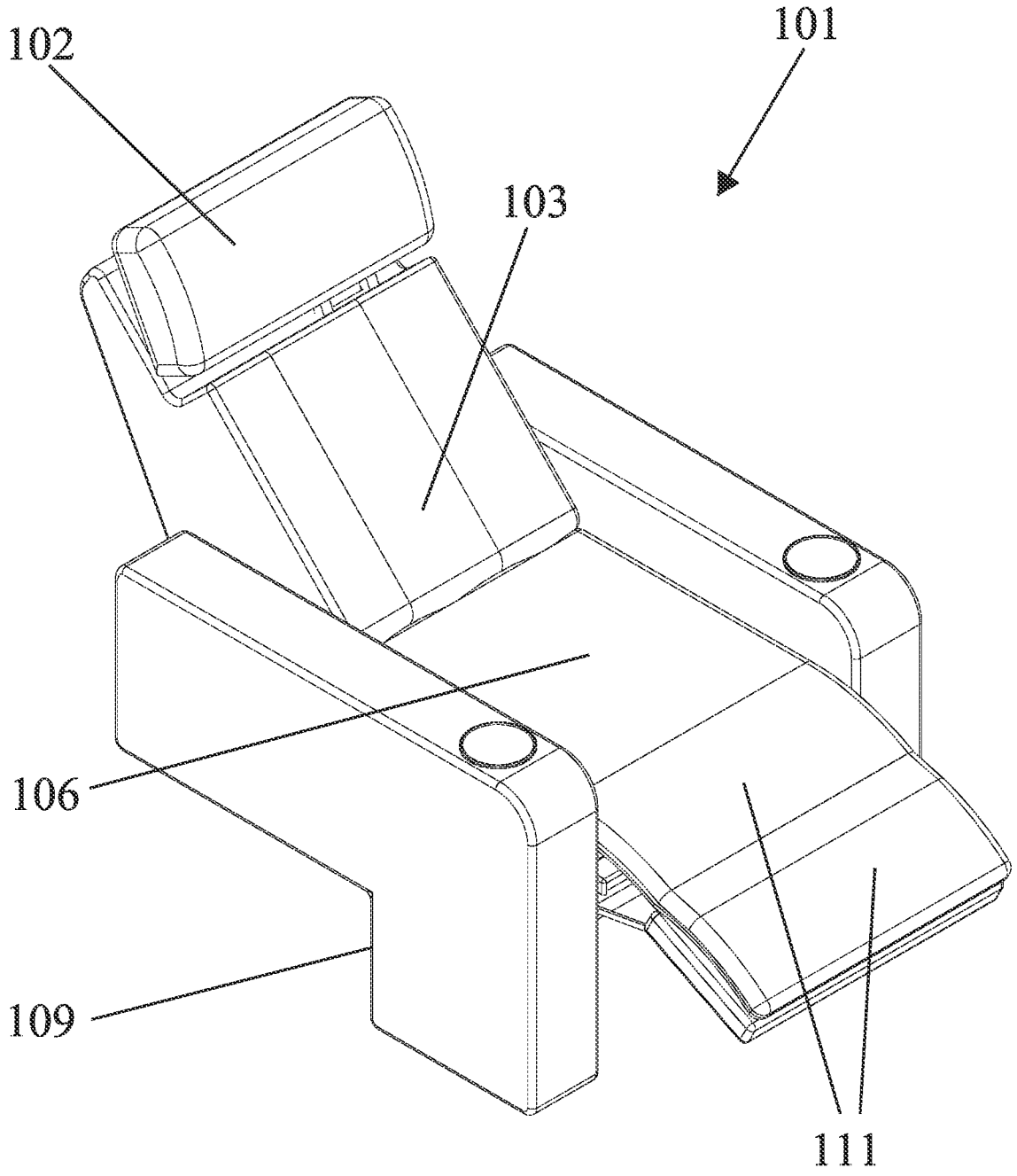
FIG. 8 illustrates a perspective view of the theater chair of the present invention with the backrest in the reclining position, the footrest in the extended position, and the headrest in the extended position.

FIG. 8 illustrates a perspective view of theater chair 101 of the present invention with backrest 103 in the reclining position, footrest 111 in the extended position, also referred to as the open position, and headrest 102 in the extended position. Backrest 103 is disposed adjacent to seat cushion 106 and tilts rearward and forward in relation to seat cushion 106. Footrest 111 is disposed adjacent to seat cushion 106 and extends to the open position and retracts to the closed position in relation to vertical member 109. Headrest 102 is disposed adjacent to backrest 103 and extends outwardly and inwardly in relation to backrest 103.

Figure 9:
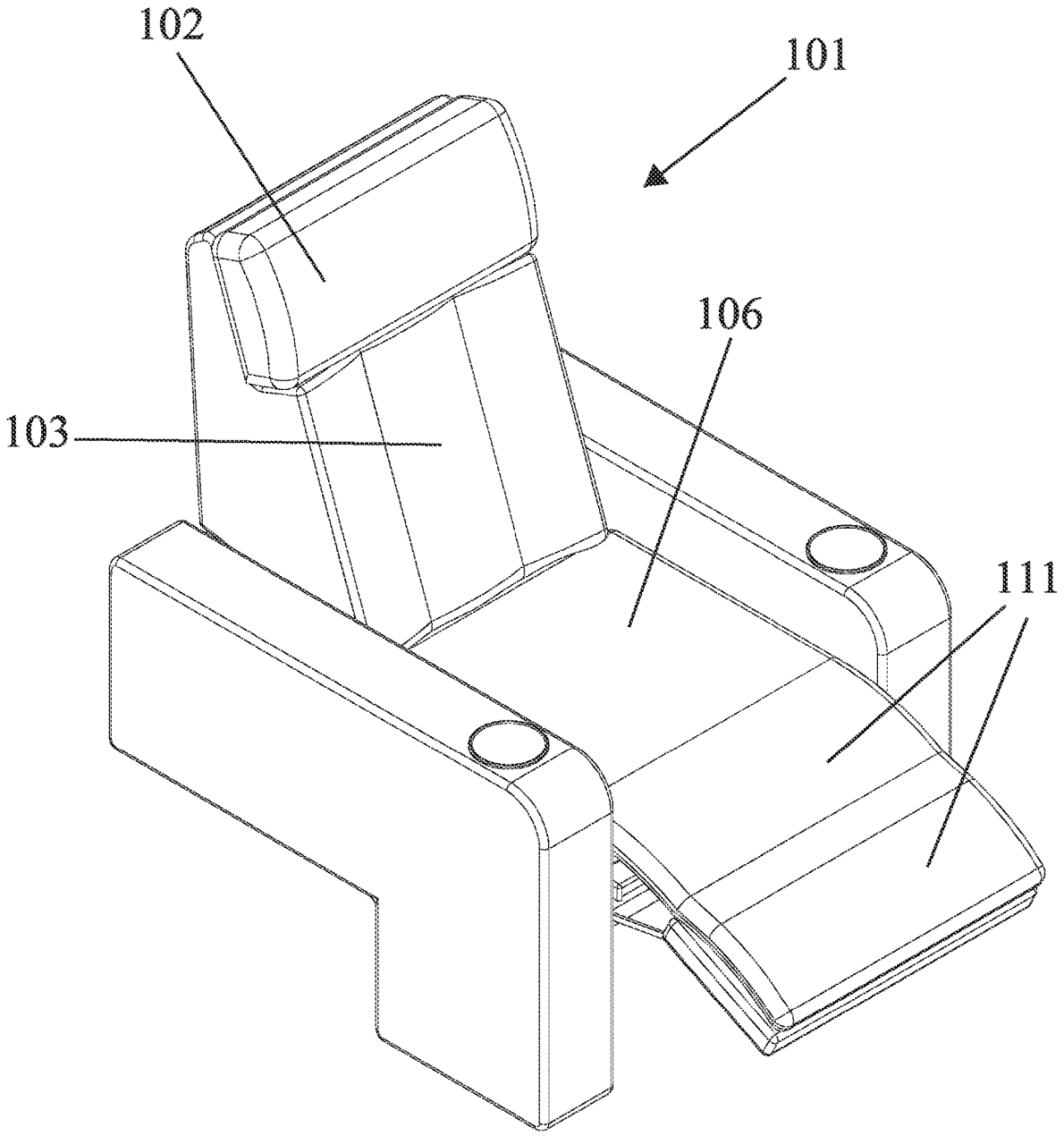
FIG. 9 illustrates a perspective view of the theater chair of the present invention with the footrest in the extended position.

FIG. 9 illustrates a perspective view of theater chair 101 of the present invention with footrest 111 in the extended position. Footrest 111 moves independently of backrest 103 and headrest 102.

Figure 10:
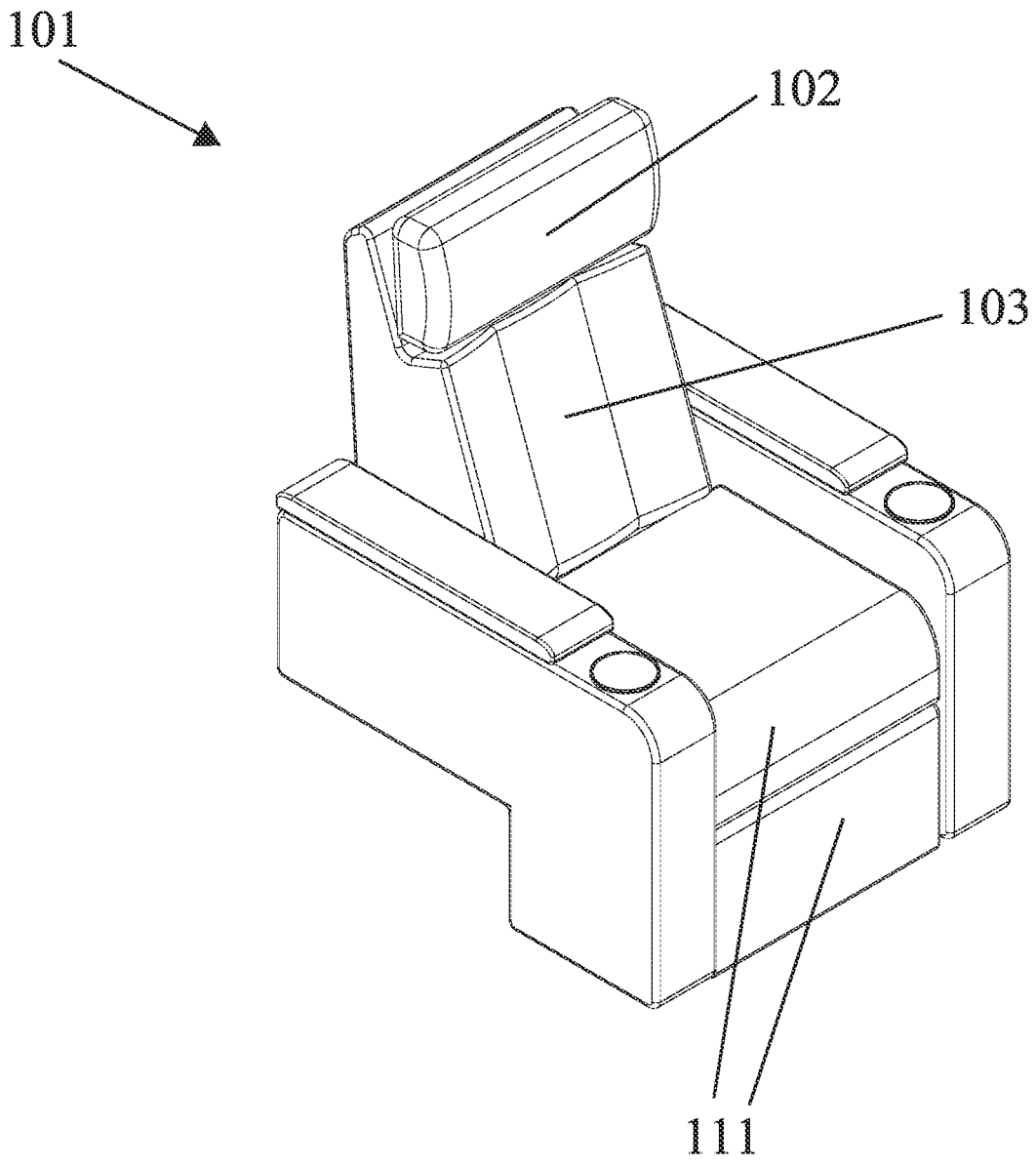
FIG. 10 illustrates a perspective view of the theater chair of the present invention with the headrest in the extended position.

FIG. 10 illustrates a perspective view of theater chair 101 of the present invention with headrest 102 in the extended position. Headrest 102 moves independently of backrest 103 and footrest 111.

Figure 11:
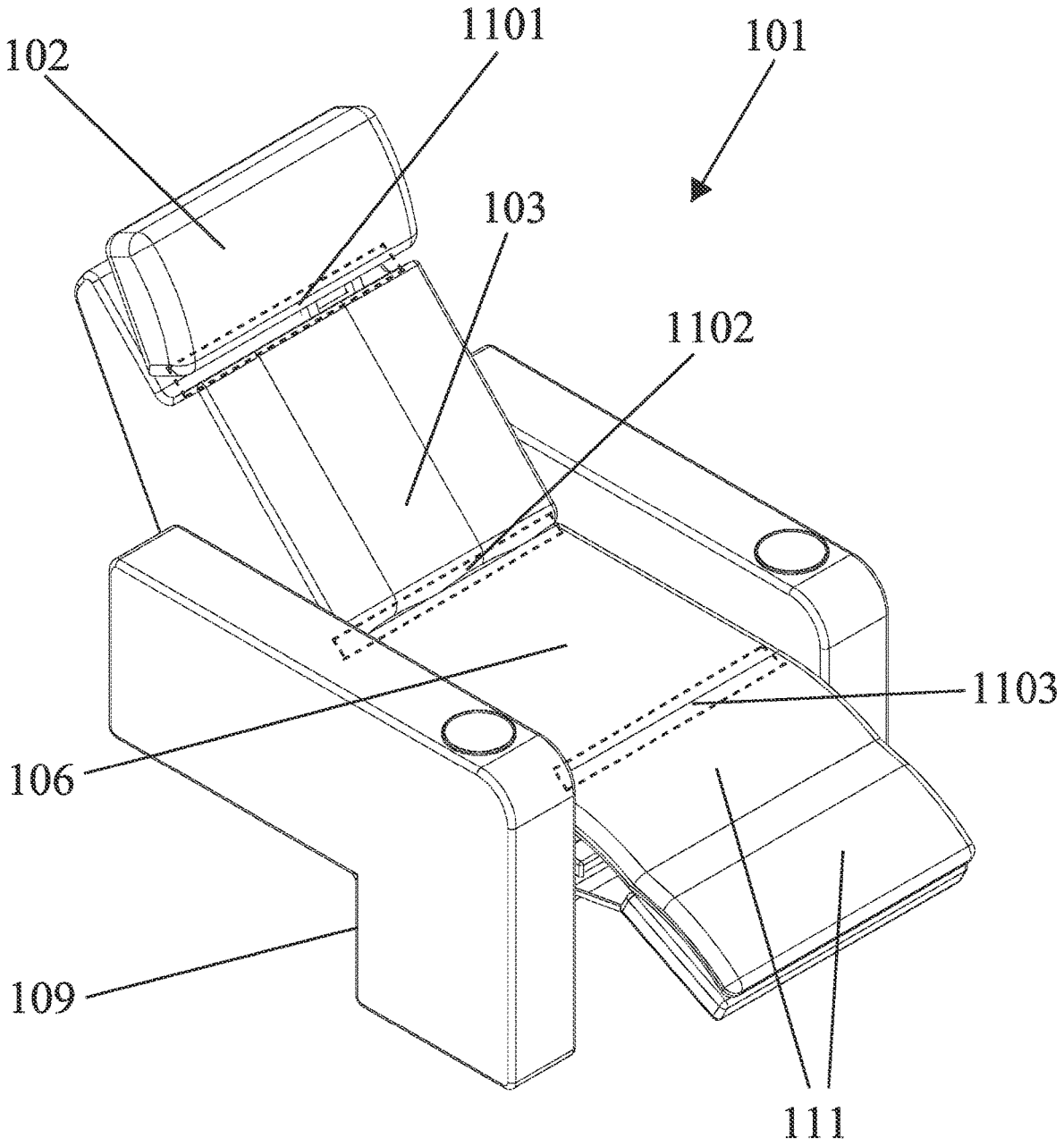
FIG. 11 illustrates a perspective view of the theater chair of the present invention showing the location of the hinges connected to the backrest in the reclining position, the footrest in the extended position, and the headrest in the extended position.

FIG. 11 illustrates a perspective view of theater chair 101 of the present invention showing the location of backrest hinge 1102, footrest hinge 1103, and headrest hinge 1101. Backrest hinge 1102 is hingeably attached to backrest 103 and seat cushion 106 and allows backrest 103 to tilt rearward and forward in relation to seat cushion 106. Footrest hinge 1103 is hingeably attached to footrest 111 and seat cushion 106 and allows footrest 111 to extend and retract in relation to vertical member 109. Headrest hinge 1101 is hingeably attached to headrest 102 and backrest 103 and allows headrest 102 to extend outwardly and inwardly in relation to backrest 103. Headrest hinge 1101 provides hinging of headrest 102 in addition to extension from backrest 103.

In one embodiment of the present invention, seat cushion 106 may move horizontally when backrest 103 tilts rearward and forward in relation to seat cushion 106 and/or footrest 111 extends and retracts in relation to vertical member 109.

Figure 12:
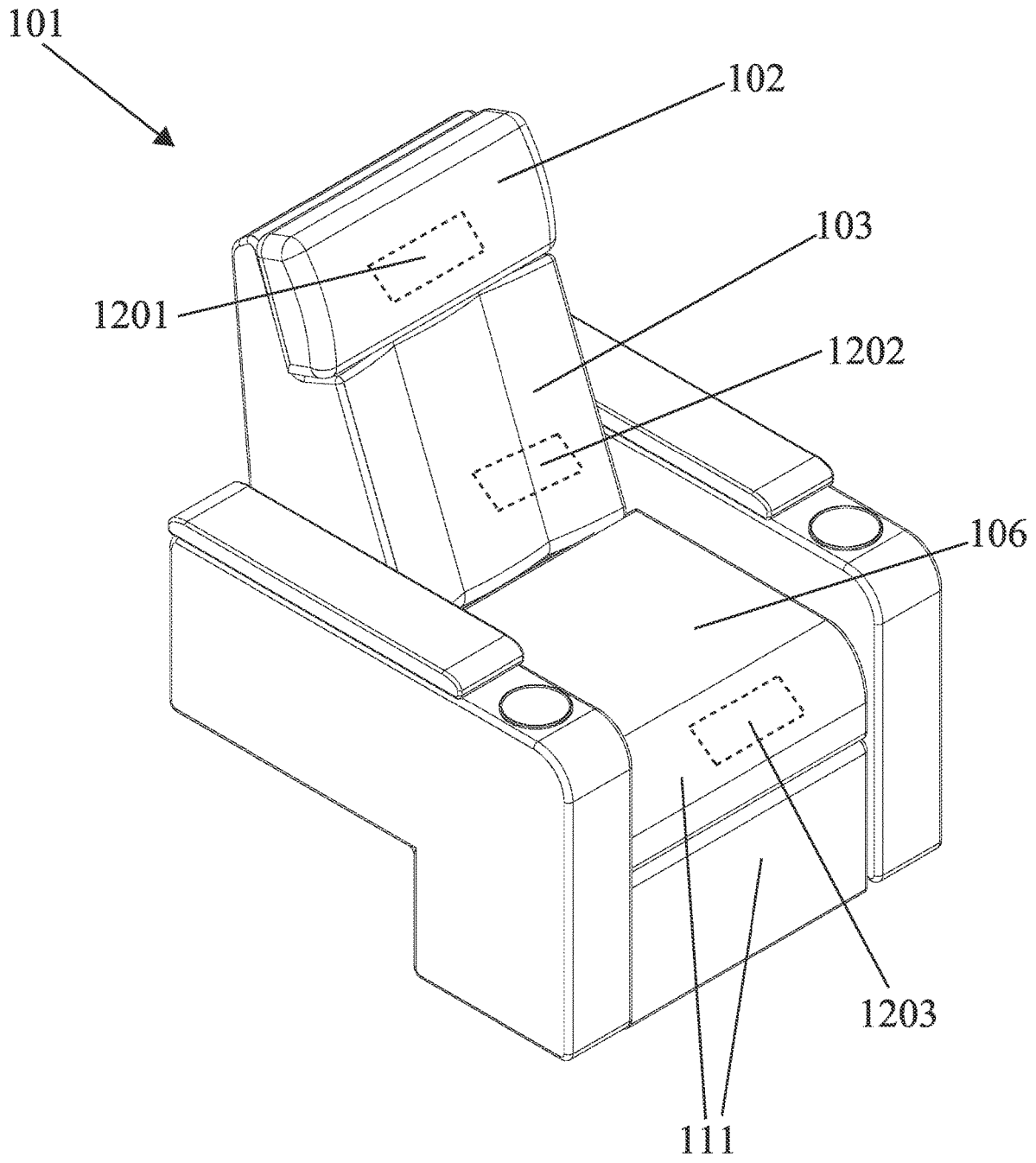
FIG. 12 illustrates a perspective view of the theater chair of the present invention showing the location of the motors connected to the backrest, the footrest, and the headrest.

FIG. 12 illustrates a perspective view of theater chair 101 of the present invention showing the location of first motor 1202, second motor 1203, and third motor 1201. First motor 1202 facilitates the rearward and forward tilting of backrest 103 in relation to seat cushion 106. Second motor 1203 facilitates the extension and retraction of footrest 111. Third motor 1201 facilitates the outward and inward extension of headrest 102 in relation to backrest 103.

First motor 1202 is connected to backrest hinge 1102 and facilitates the rearward and forward tilting of backrest 103 in relation to seat cushion 106. Second motor 1203 is connected to footrest hinge 1103 and facilitates the extension and retraction of footrest 111. Third motor 1201 is connected to headrest hinge 1101 and facilitates the outward and inward extension of headrest 102 in relation to backrest 103.

First motor 1202, second motor 1203, and third motor 1201 are disposed in theater chair 101 and are controlled with a controller. The controller may be mounted on theater chair 101, wirelessly connected, or any other means that allow the control of the various motors. The controller allows a user to control first motor 1202 in order to tilt backrest 103 rearward and forward in relation to seat cushion 106, second motor 1203 in order to extend and retract footrest 111, and third motor 1201 in order to extend headrest 102 outwardly and inwardly in relation to backrest 103.

First motor 1202, second motor 1203, and third motor 1201 operate independently from each other. The respective motors comprise any type of motors that allow for the desired movement of the respective parts of theater chair 101. First motor 1202, second motor 1203, and third motor 1201 may be located in any locations in theater chair 101. Alternatively, any of first motor 1202, second motor 1203, and third motor 1201 may be mounted externally from theater chair 101, so long as they are still offering the same functionality.

Backrest 103, headrest 102, and footrest 111 all operate independently.

Backrest hinge 1102, footrest hinge 1103, and headrest hinge 1101 comprise any type of hinges that allow for the desired movement of the respective parts of theater chair 101. Backrest hinge 1102, footrest hinge 1103, and headrest hinge 1101 operate such that they cannot hinge without the use of the respective motors, and they lock into place when the respective motors are not being operated by the user.

First motor 1202, second motor 1203, and third motor 1201 may each be powered by any suitable power source, including battery powered, electrical power from an outside source, solar powered, etc.

Backrest hinge 1102 allows backrest 103 to tilt rearwardly and forwardly in relation to seat cushion 106. Footrest hinge 1103 allows footrest 111 to extend and retract such that when footrest 111 is in the closed position, it is substantially parallel to vertical member 109. Headrest hinge 1101 allows headrest 102 to extend outwardly and inwardly in relation to backrest 103, as well as tilting in relation to backrest 103.

Headrest 102, backrest 103, and footrest 111 have a wide range of motion and can stop at any point between full extension of the respective hinges.

Left side base wall 107 and right side base wall 107', backrest left side panel 112 and backrest right side panel 112', seatback rear panel 301, left side rear base wall 303 and right side rear base wall 303', lower rear panel 302, and footrest 111 when in the closed position generally conceal the backrest hinge 1102, footrest hinge 1103, headrest hinge 1101, first motor 1202, second motor 1203, and third motor 1201 when theater chair 101 is disposed on an L-shaped seating platform.

Seatback rear panel 301 is securably attached to seatback 103 and moves with seatback 103 when seatback 103 hinges. Lower rear panel 302 is attached to left side rear base wall 303 and right side rear base wall 303' and remains in place and allows seatback rear panel 301 and seatback 103 to hinge.

Figure 13:
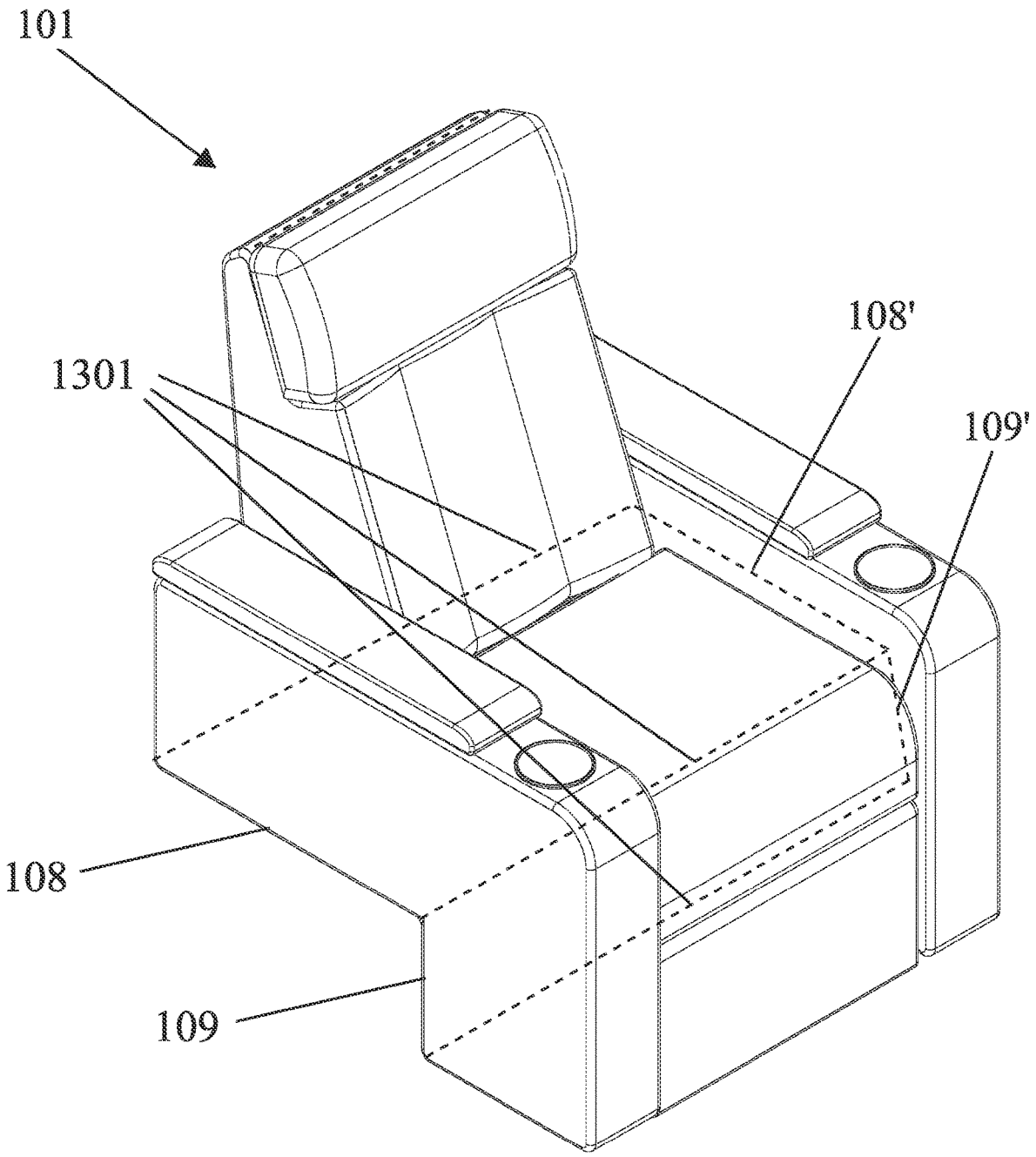
FIG. 13 illustrates a perspective view of the theater chair of the present invention showing location of the L-base support bars of the mountable base.

FIG. 13 illustrates a perspective view of theater chair 101 of the present invention showing location of the L-base support bars 1301 of the mountable base. The pair of L-shaped bases formed by left vertical member 109 and left horizontal member 108 and right vertical member 109' and right horizontal member 108' are connected by L-base support bars 1301 to form the mountable base of theater chair 101. The pair of vertical members and horizontal members may be visible or covered by the pair of side base walls, or part of the pair of side base walls.

The mountable base created by the pair of L-shaped bases is mountable on a seating platform comprising a vertical wall and a horizontal wall, which is common in theaters, including theaters that are being retrofitted with new seating. Seating platforms of theaters are typically L-shaped, and the L-shaped base of the present invention fits snugly on the platform and can be secured in place.

L-base support bars 1301 may comprises bars, plates, or other means that provide proper connection of the pair of L-shaped bases. One or more L-base support bars 1301 are installed as needed.

Additional frame pieces may be present in theater chair 101 as required to provide support for the various pieces of theater chair 101 and allow theater chair 101 to operate as intended and be mounted as intended.

Figure 14:
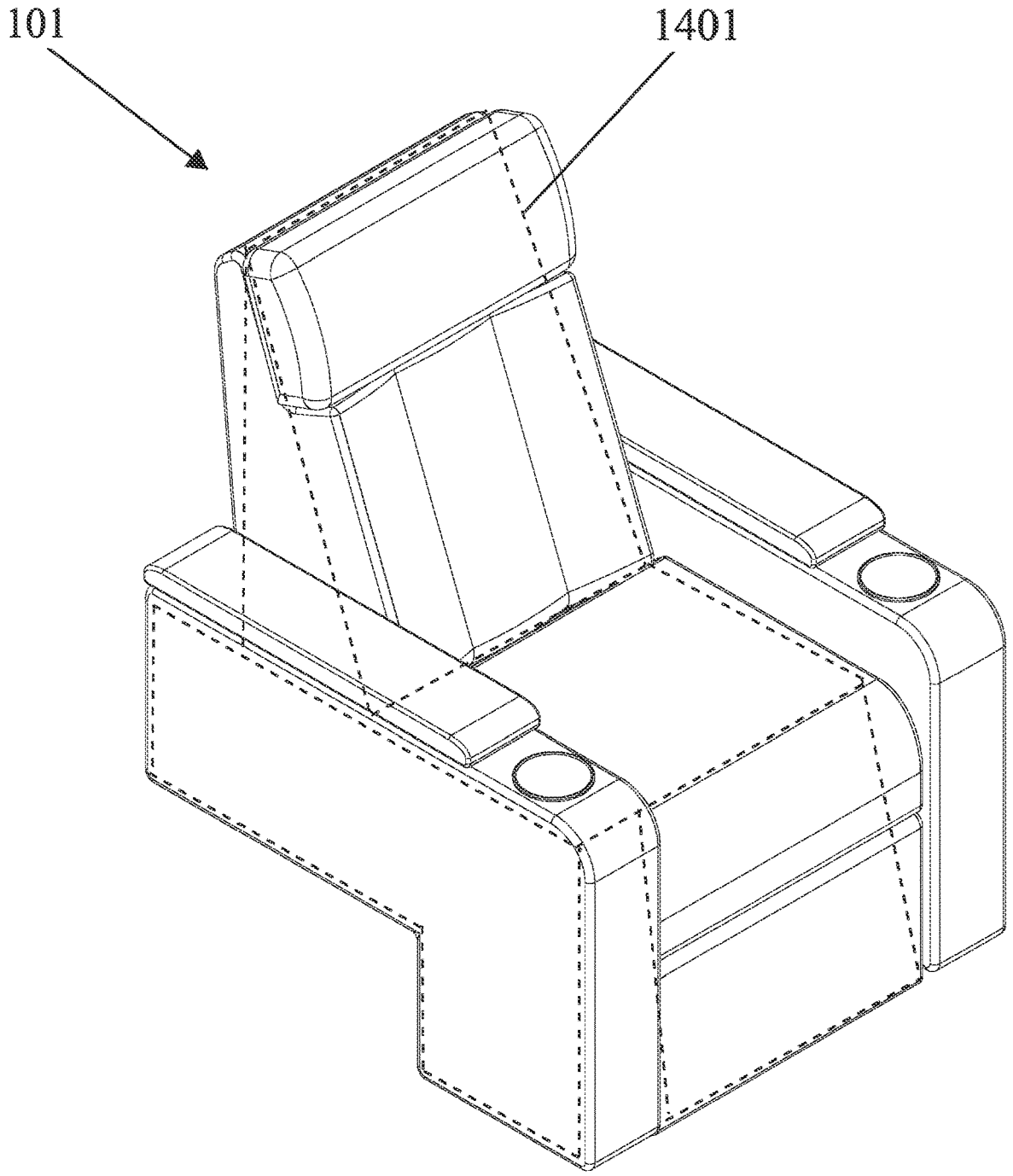
FIG. 14 illustrates a perspective view of an alternate embodiment of the theater chair of the present invention showing the inner skeleton.

FIG. 14 illustrates a perspective view of an alternate embodiment of theater chair 101 of the present invention showing inner skeleton 1401. Inner skeleton 1401 may be included in the preferred embodiment as needed for support of theater chair 101. Certain parts of theater chair 101 may be disposed on inner skeleton 1401 as needed. Backrest hinge 1102, footrest hinge 1103, and headrest hinge 1101 may attach to different connection points of theater chair 101 of the present invention, as desired. Backrest hinge 1102 is hingeably attached to backrest 103 and may attach to inner skeleton 1401 and allows backrest 103 to tilt rearward and forward in relation to seat cushion 106. Footrest hinge 1103 is hingeably attached to footrest 111 and inner skeleton 1401 and allows footrest 111 to extend and retract in relation to vertical member 109. Headrest hinge 1101 is hingeably attached to headrest 102 and inner skeleton 1401 and allows headrest 102 to extend outwardly and inwardly in relation to backrest 103. Headrest hinge 1101 provides hinging of headrest 102 in addition to extension from backrest 103.

For simplicity, certain parts of inner skeleton 1401 have been omitted, such as certain cross bar that left side pieces with the corresponding right side pieces.

Vertical member 109, horizontal member 108, seat cushion 106, backrest 103, footrest 111, headrest 102, first motor 1202, second motor 1203, third motor 1201, backrest hinge 1102, left side base wall 107, right side base wall 107', left arm rest 104, right arm rest 104', backrest left side panel 112, backrest right side panel 112', seatback rear panel 301, left side rear base wall 303 and right side rear base wall 303', lower rear panel 302, footrest hinge 1103, and headrest hinge 1101 are disposed on at least inner skeleton 1401. The L-shaped base created by vertical member 109 and horizontal member 108 may be part of or attached to inner skeleton 1401.

The mountable base created by the pair of L-shaped bases, or any elements therein, may be part of inner skeleton 1401 or may be separate pieces attached to inner skeleton 1401.

Inner skeleton 1401, or parts of inner skeleton 1401, may be included as part of the preferred embodiment of theater chair 101. Inner skeleton 1401, or parts of inner skeleton 1401, may be included and built into any of the various elements of theater chair 101, or any of the various elements of theater chair 101 may be disposed on inner skeleton 1401.

The best mode for carrying out the invention has been described herein. The previous embodiments are described in sufficient detail to enable those skilled in the art to make and use the invention. It is to be understood that other embodiments would be evident based on the present disclosure, and that system, process, or mechanical changes may be made without departing from the scope of the present invention.

In the previous description, numerous specific details and examples are given to provide a thorough understanding of the invention. However, it will be apparent that the invention may be practiced without these specific details and specific examples. While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations that fall within the scope of the included claims. All matters previously set forth herein or shown in the accompanying figures are to be interpreted in an illustrative and non-limiting sense.

What is claimed is:

1. A theater chair, comprising:

a mountable base, wherein the mountable base consists of a pair of L-shaped bases formed by a pair of vertical members and a pair of horizontal members, wherein the of L-shaped bases are connected by one or more L-base support bars, wherein the mountable base is mountable on an L-shaped seating platform comprising a vertical wall and a horizontal wall, wherein when the theater chair is disposed on the L-shaped seating platform, the pair of vertical members are disposed on the vertical wall of the L-shaped seating platform and the pair of horizontal members are disposed on the horizontal wall of the L-shaped seating platform;

a seat cushion, wherein the seat cushion is disposed parallel to the horizontal member;

a backrest, wherein the backrest is disposed adjacent to the seat cushion and tilts rearward and forward in relation to the seat cushion;

a footrest, wherein the footrest is disposed adjacent to the seat cushion and extends to the open position and retracts to the closed position in relation to the vertical member;

a headrest, wherein the headrest is disposed adjacent to the backrest and extends outwardly and inwardly in relation to the backrest;

a first motor, wherein the first motor is connected to the backrest and facilitates the rearward and forward tilting of the backrest, wherein the first motor is located substantially behind the backrest;

a second motor, wherein the second motor is connected to the footrest and facilitates the extension and retraction of the footrest, wherein the second motor is located substantially behind the footrest; and a third motor, wherein the third motor is connected to the headrest and facilitates the outward and inward extension of the headrest in relation to the backrest, wherein the third motor is located substantially behind the headrest, and wherein the first motor, the second motor, and the third motor are operated independently.

2. The theater chair of claim 1, wherein the footrest conceals the vertical wall of the L-shaped seating platform when in the closed position.

3. The theater chair of claim 1, wherein the first motor, the second motor, and the third motor are controlled with a controller.

4. The theater chair of claim 3, wherein the controller is disposed on the theater chair.

5. A theater chair, comprising:

a mountable base, wherein the mountable base consists of a pair of L-shaped bases formed by a pair of vertical members and a pair of horizontal members, wherein the of L-shaped bases are connected by one or more L-base support bars, wherein the mountable base is mountable on an L-shaped seating platform comprising a vertical wall and a horizontal wall, wherein when the theater chair is disposed on the L-shaped seating platform, the pair of vertical members are disposed on the vertical wall of the L-shaped seating platform and the pair of horizontal members are disposed on the horizontal wall of the L-shaped seating platform;

a seat cushion, wherein the seat cushion is disposed parallel to the horizontal members;

a backrest;

a backrest hinge, wherein the backrest hinge is hingeably attached to the backrest and the seat cushion, wherein the backrest is hingeably attached to the backrest hinge and is disposed adjacent to the seat cushion and tilts rearward and forward in relation to the seat cushion;

a pair of side base walls, wherein the backrest is hingeably attached to the pair of side base walls;

a pair of arm rests, wherein the pair of arm rests are disposed on the pair of side base walls;

a pair of backrest side panels, wherein the pair of backrest side panels are disposed on the backrest;

a seatback rear panel, wherein the seatback rear panel is securably attached to the seatback;

a pair of side rear base walls, wherein pair of side rear base walls are attached to the pair of arm rests;

a lower rear panel, wherein the lower rear panel is attached to the pair of side rear base walls;

a footrest;

a footrest hinge, wherein the footrest hinge is hingeably attached to the footrest and the seat cushion, wherein the footrest is hingeably attached to the footrest hinge and is disposed adjacent to the seat cushion and extends to the open position and retracts to the closed position in relation to the vertical member;

a headrest;

a headrest hinge, wherein the headrest hinge is hingeably attached to the backrest and the headrest, wherein the headrest is hingeably attached to the headrest hinge and is disposed adjacent to the backrest and extends outwardly and inwardly in relation to the backrest;

wherein the headrest is disposed on the headrest hinge and adjacent to the backrest and extends outwardly and inwardly in relation to the backrest;

a first motor, wherein the first motor is connected to the backrest hinge and facilitates the rearward and forward tilting of the backrest, wherein the first motor is located substantially behind the backrest;

a second motor, wherein the second motor is connected to the footrest hinge and facilitates the extension and retraction of the footrest, wherein the second motor is located substantially behind the footrest; and a third motor, wherein the third motor is connected to the headrest hinge and facilitates the outward and inward extension of the headrest in relation to the backrest, wherein the third motor is located substantially behind the headrest, and wherein the first motor, the second motor, and the third motor are operated independently.

6. The theater chair of claim 5, wherein the pair of side base wall, the pair of backrest side panels, the seatback rear panel, the pair of side rear base walls, the lower rear panel, and the footrest when in the closed position generally conceal the backrest hinge, the footrest hinge, the headrest hinge, the first motor, the second motor, and the third motor when the theater chair is disposed on the L-shaped seating platform.

7. A theater chair, comprising:

an inner skeleton;

a mountable base, wherein the mountable base consists of a pair of L-shaped bases formed by connecting to the inner skeleton, wherein the mountable base is mountable on an L-shaped seating platform comprising a vertical wall and a horizontal wall, wherein when the theater chair is disposed on the L-shaped seating platform, the pair of L-shaped bases are disposed on the vertical wall and the horizontal wall of the L-shaped seating platform;

a seat cushion, wherein the seat cushion is disposed on the inner skeleton parallel to the horizontal member;

a backrest;

a backrest hinge, wherein the backrest hinge is hingeably attached to the backrest and the inner skeleton, wherein the backrest is hingeably attached to the backrest hinge and is disposed adjacent to the seat cushion and tilts rearward and forward in relation to the seat cushion;

a pair of side base walls, wherein the backrest is hingeably attached to the inner skeleton;

a pair of arm rests, wherein the pair of arm rests are disposed on the inner skeleton;

a pair of backrest side panels, wherein the pair of backrest side panels are disposed on the inner skeleton;

a seatback rear panel, wherein the seatback rear panel is securably attached to the inner skeleton;

a pair of side rear base walls, wherein pair of side rear base walls are attached to the inner skeleton;

a lower rear panel, wherein the lower rear panel is attached to the inner skeleton;

a footrest;

a footrest hinge, wherein the footrest hinge is hingeably attached to the footrest and the inner skeleton, wherein the footrest is hingeably attached to the footrest hinge and is disposed adjacent to the seat cushion and extends to the open position and retracts to the closed position in relation to the vertical member;

a headrest;

a headrest hinge, wherein the headrest hinge is hingeably attached to the headrest and the inner skeleton, wherein the headrest is hingeably attached to the headrest hinge and is disposed adjacent to the backrest and extends outwardly and inwardly in relation to the backrest;

wherein the headrest is disposed on the headrest hinge and adjacent to the backrest and extends outwardly and inwardly in relation to the backrest;

a first motor, wherein the first motor is disposed on the inner skeleton and connected to the backrest hinge and facilitates the rearward and forward tilting of the backrest;

a second motor, wherein the second motor is disposed on the inner skeleton and is connected to the footrest hinge and facilitates the extension and retraction of the footrest; and a third motor, wherein the third motor is disposed on the inner skeleton and connected to the headrest hinge and facilitates the outward and inward extension of the headrest in relation to the backrest.

* * * * *